US005305055A

United States Patent [19]

Ebner et al.

[11] Patent Number: 5,305,055

[45] Date of Patent: Apr. 19, 1994

[54] AUTOMATIC CALL TO SELECTED REMOTE OPERATORS IN RESPONSE TO PREDETERMINED MACHINE CONDITIONS

[75] Inventors: Fritz F. Ebner, Rochester; Andrew J. Aikens, Webster, both of N.Y.

[73] Assignee: Xerox Corporation, Stamford, Conn.

[21] Appl. No.: 991,600

[22] Filed: Dec. 16, 1992

[51] Int. Cl.[5] ..... G03G 15/00

[52] U.S. Cl. ..... 355/200; 355/206

[58] Field of Search ..... 355/203, 205, 206, 207; 395/113; 358/405, 406; 364/138; 371/15.1; 340/679

[56] References Cited

U.S. PATENT DOCUMENTS

| | | | |
|---|---|---|---|
| 3,842,408 | 10/1974 | Wells | 340/216 |
| 4,224,613 | 9/1980 | Kaiser et al. | 340/679 |
| 4,549,219 | 10/1985 | Sue et al. | 358/405 |
| 4,583,834 | 4/1986 | Seko et al. | 355/206 |
| 4,922,294 | 5/1990 | Nakagami et al. | 355/209 |
| 5,077,582 | 12/1991 | Kravette et al. | 355/206 |

FOREIGN PATENT DOCUMENTS

| | | | |
|---|---|---|---|
| 4-184368 | 7/1992 | Japan | 355/206 |

*Primary Examiner*—Joan H. Pendegrass

*Attorney, Agent, or Firm*—Ronald F. Chapuran

[57] ABSTRACT

A method of automatic notification to a selected remote notification device in response to the machine conditions detected by the machine monitoring element including displaying machine condition options for operator selection of predetermined machine conditions for automatic notification to a remote station, selectively programming the predetermined machine conditions for notification to the remote location, monitoring the operation of the image processing apparatus relative to forming images on the medium, determining a machine condition to be a condition to require a notification to the remote location, and automatically initiating a notification to the remote location, the notification including a designation of the image processing apparatus and the type of machine condition.

11 Claims, 7 Drawing Sheets

AUTOMATIC CALL TO SELECTED REMOTE OPERATORS IN RESPONSE TO PREDETERMINED MACHINE CONDITIONS

BACKGROUND OF THE INVENTION

The invention relates to paging or calling a remote station or operator and more particularly, to the automatic notification to a remote station or operator in response to predetermined machine malfunctions.

It is important in the operation of complex electronic equipment, such as reproduction machines, to maintain the efficiency and productivity of the machine. Machine downtime due to various conditions such as paper jams, the need to reload paper trays, and undesirable quality due to factors such as low toner severely impact machine productivity. In addition, locations with multiple machine operations are often without an immediately available operator or trouble shooter. An assigned expediter may be at the location of machine when another machine needs immediate attention to continue operation. It is important for efficiency to reduce machine down time and to improve the efficiency of operator time spent in monitoring and correcting the machine operation at a specific location.

In the prior art, U.S. Pat. No. 4,922,294 to Nakagami et al. discloses an image forming apparatus equipped with a sensor for detecting the requirement of replenishment and exchange of expendable supplies, parts and the like. The apparatus forms a pre-warning image (33) which is distinguishable from a regular image (35) on the same sheet on which a regular image is formed corresponding to an original (21) or other image data so that operators can easily recognize whether a pre-warning image is on the sheet or not while confirming the regular image. The pre-warning image is formed on a sheet whether it is a roll sheet or cut sheet whenever manual handling is necessary. See Col 1, lines 60–69, Col. 2, lines 1–5.

U.S. Pat. No. 4,224,613 to Kaiser et al. discloses a warning system for printing presses. The system provides a warning system for a printing press which sounds an acoustic warning when any one of a given set of running conditions is exceeded or departed from. See Col. 1, lines 38–41.

U.S. Pat. No. 3, 3,842,408 to Wells discloses a system for providing an indication of a remote condition or problem within a machine. A transmitter coupled to the machine operates to separately sense different conditions of the machine and transmits separate signals corresponding to the sensed condition of the machine. The signals are carried via the conventional electric power distributing lines to a receiver and indicator apparatus. The indicator apparatus functions to selectively sense the signals from the receiver to provide a visual indication of the sensed condition of the machine.

A difficulty with prior art systems is that video or audio alarm systems are often limited in the range of notification and the inability to directly alert an operator who may be at one of several locations. In addition, once alerted, the operator often has little or no information on the nature of the alert or the condition of the machine needing attention.

It would be desirable, therefore, to minimize machine downtime and provide the capability of rapid operator response to machine requirements and for the operator to be able to pre-select the machine conditions requiring notice. It would also be desirable to be able to immediately alert an operator at a remote location for fast response and to be able to identify for the operator the status or condition of the machine that provided the notification.

It is an object of the present invention, therefore, to provide a new and improved technique for notification of an operator remote from a machine of the need for machine assistance. It is still another object of the present invention to notify a remote operator the type of assistance required to maintain machine productivity. It is still another object of the present invention to allow the pre-setting of conditions demanding automatic calling to a remote operator. Other advantages of the present invention will become apparent as the following description proceeds, and the features characterizing the invention will be pointed out with particularity in the claims annexed to and forming a part of this specification.

SUMMARY OF THE INVENTION

Briefly, the present invention is a method of automatic notification to a selected remote station or operator in response to the machine conditions detected by a machine monitoring element in an image processing apparatus, including displaying machine condition options for operator selection of predetermined machine conditions for automatic notification to the remote station, selectively programming the predetermined machine conditions for notification to the remote location, monitoring the operation of the image processing apparatus, determining a machine condition to be a condition to require a notification to the remote location, and automatically initiating a notification to the remote location, the notification including a designation of the particular image processing apparatus, and the type of machine condition.

For a better understanding of the present invention, reference may be had to the accompanying drawings wherein the same reference numerals have been applied to like parts and wherein:

DETAILED DESCRIPTION OF THE DRAWINGS

Figure 1:
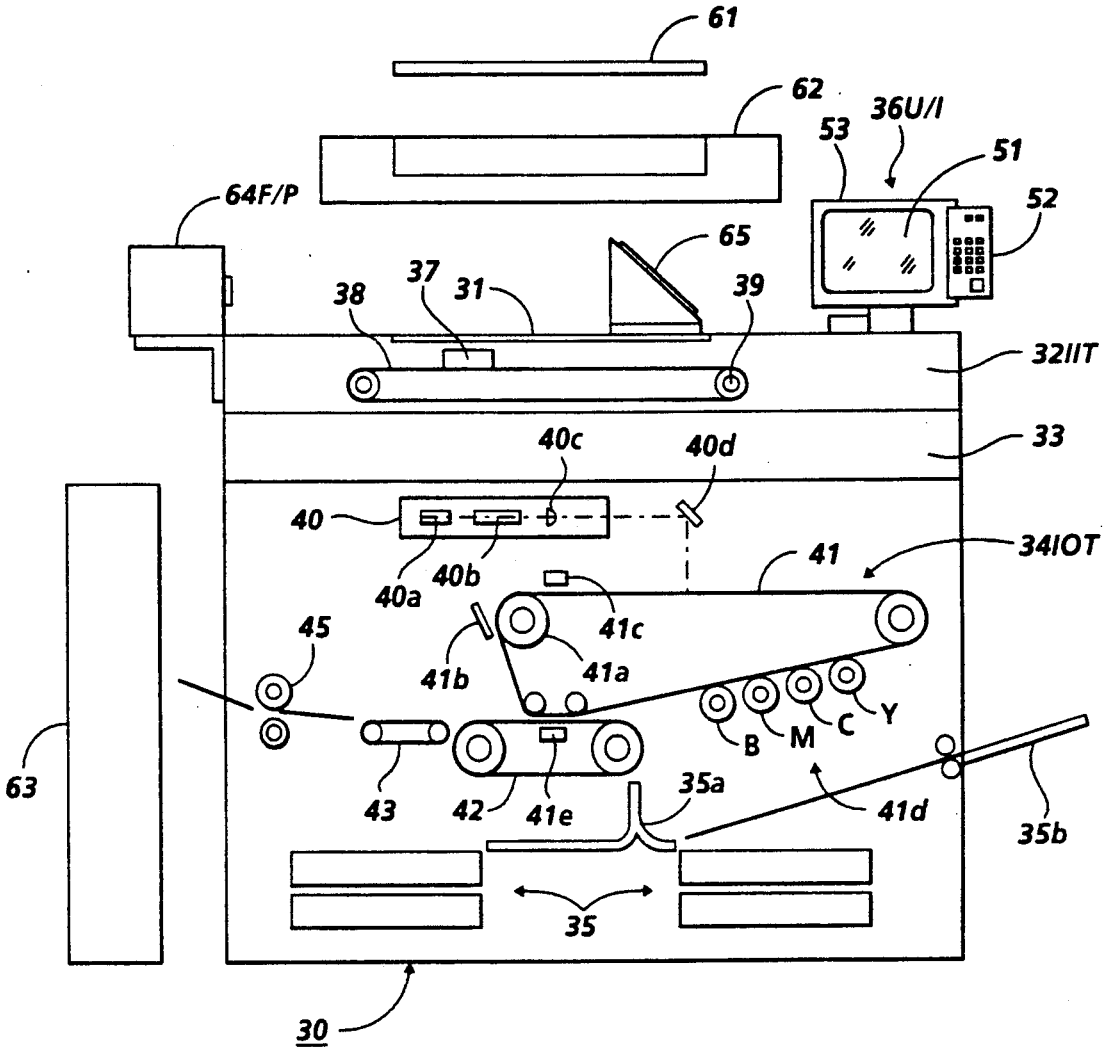
FIG. 1 is a schematic elevational view depicting various operating components and subsystems of a typical machine incorporating the present invention.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention.

DETAILED DESCRIPTION OF THE PREFERRED EMBODIMENT

For a general understanding of the features of the present invention, reference is made to the drawings. In the drawings, like reference numerals have been used throughout to identify identical elements.

FIG. 1 shows one example of the overall construction of a color copying machine to which this invention is applied. A typical color copying machine to which this invention is applied is formed with the base machine 30, composed of a platen glass plate 31, which carries the original sheet thereon, an image input terminal (IIT) 32, an electrical control system container 33, the image output terminal (IOT) 34, and a paper tray 35, and a user interface (U/I) 36 and also, as optional items, of an editing pad 61, an automatic document feeder (ADF) 62, a sorter 63, and a film projector (F/P) 64.

Electrical hardware is necessary for performing the control of the IIT, IOT, U/I, etc. mentioned above, and a plural number of boards for control of each of the processing units, such as the IIT, IPS, U/I, F/P, and so forth, which perform the image-forming process for the output signals from the IIT, and these are accommodated further in the electrical control system container 33.

The IIT 32 is composed of an imaging unit 37, the wire 38 for driving the said unit, the driving pulley 39, and so forth, and IIT 32 reads a color original sheet for each of the primary colors B(Blue, G(Green) and R (Red) by means of a CCD line sensor and a color filter provided inside the imaging unit 37, converts the data so obtained into digital image signals and then outputs the signals to the IPS.

In the IPS, the B, G, and R signals mentioned above are transformed into the primary colors of the toner, i.e. Y(Yellow), C(Cyan), M(Magenta), and K(Black), and then, with various data processing being applied to the data so obtained for the purpose of enhancing the reproduction fidelity and fineness, and so forth, the IPS converts the toner signals of the process color in harmonious gradation into binary toner signals and outputs them to the IOT 34.

The IOT 34, which is provided with a scanner 40 and a photosensitive material belt 41, converts the image signals from the abovementioned IPS into optical signals in the laster output part 40*a* and forms a latent image corresponding to the image on the original sheet on the photosensitive material belt 41 by way of the polygon mirror 40*b*, the lens 40*c*, and the reflexive mirror 40*d*. The photosensitive material belt 41, which is driven by the driving pulley 41*a*, has a cleaner 41*b*, a charging unit 41*c*, the individual developing devices for Y, M, C, and K, and a transfer device 41*e* arranged around it. And, opposite to this transfer device 41*e* is provided a transfer unit 42, which takes into it the sheet that comes transported to it from the paper tray 35 via the paper transport channel 35*a* and transfers the colors in the order of Y, M, C, and K, the transfer unit 42 being rotated four turns, for example, for full-color copying in four full colors. The sheet of paper on which the image is so transferred is then transported from the transfer unit 42 via the vacuum transport device 43 to the fixing device 45, where it is fixed, and is thereafter discharged from it. Moreover, the paper transport channel 35*a* is so designed as to accept the paper fed alternatively from the SSI (Single Sheet Inserter) 35*b*.

The U/I 36 is designed for use by the user for making the selections of the desired functions and for giving instructions regarding the conditions for the execution of the selected functions, and this system is provided with a color display unit 51 and a hardware control panel 52 installed by the side of the said display unit, and it is further combined with touch board 53, so that instructions can be given directly with the "soft buttons" on the screen. For further details reference is made to U.S. Pat. No. 5,032,903 incorporated herein.

Figure 2:
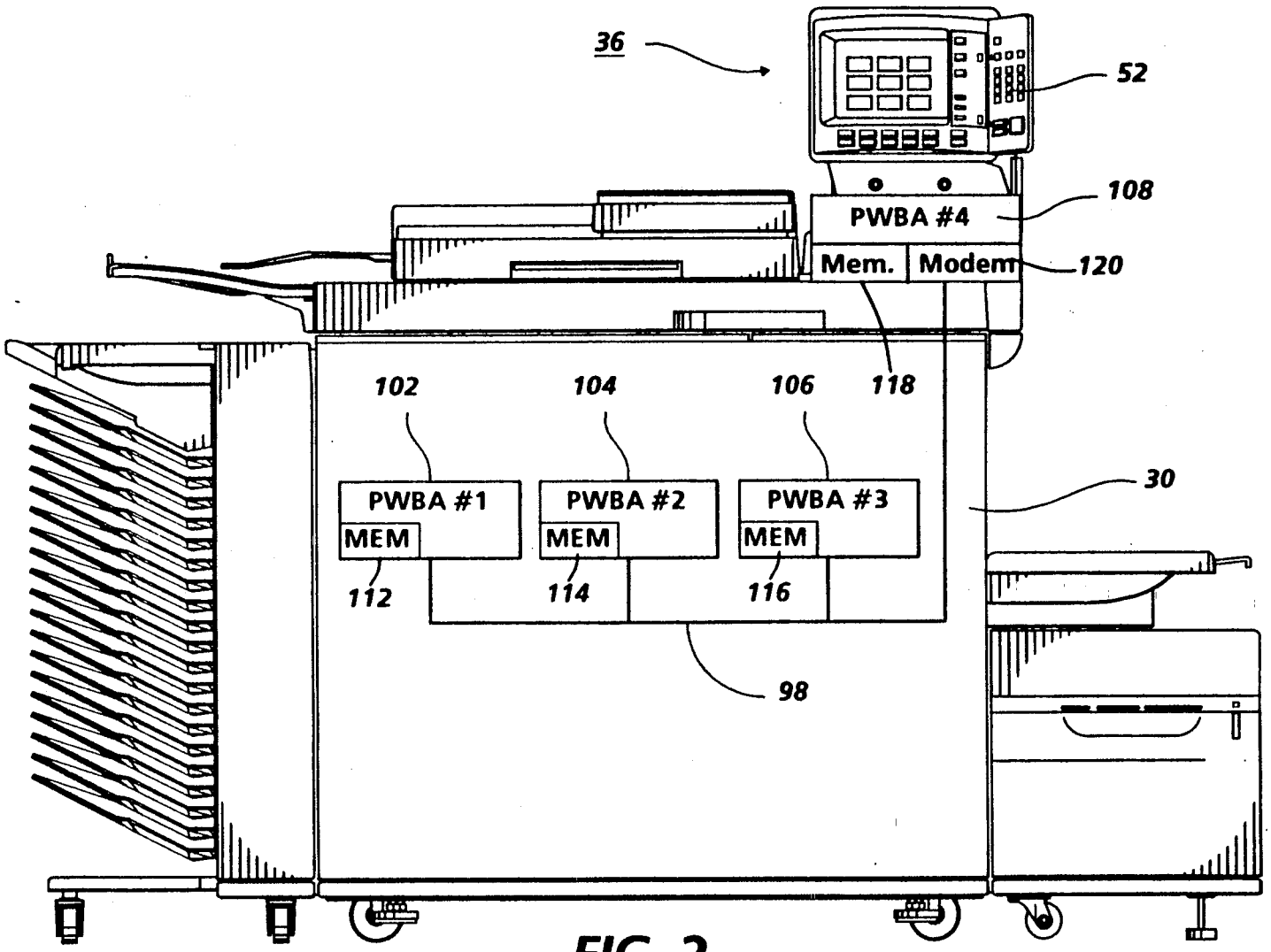
FIG. 2 is a schematic illustrating the control boards for control of the machine shown in FIG. 1.

With reference to FIG. 2, there is illustrated in general block form, the control of the base machine 30 shown in FIG. 1. The base machine is controlled by a plurality of printed wiring boards interconnected to a common channel or bus 98. For purposes of explanation, four printed wiring boards, boards 102 with memory 112, 104 with memory 114, 106 with memory 116, and 108 with memory 116 are illustrated, with printed wiring board 108 being the control for the user interface 36 and the remaining printed wiring boards providing control for predetermined systems and components of the base machine 30. Printed wiring board, 108 is also provided with modem 120 for communication with a remote location. It should be understood that the number of printed wiring boards and the manner of interconnection is merely a design choice and any other suitable control scheme for controlling the base machine is contemplated within the scope of this invention. It should also be noted that one of the printed wiring boards, for example, board 102 could be the master control for the other printed wiring boards or that there could be any number of master slave relationships of the control boards or distributed control of the various functions of the base machine.

Figure 3:
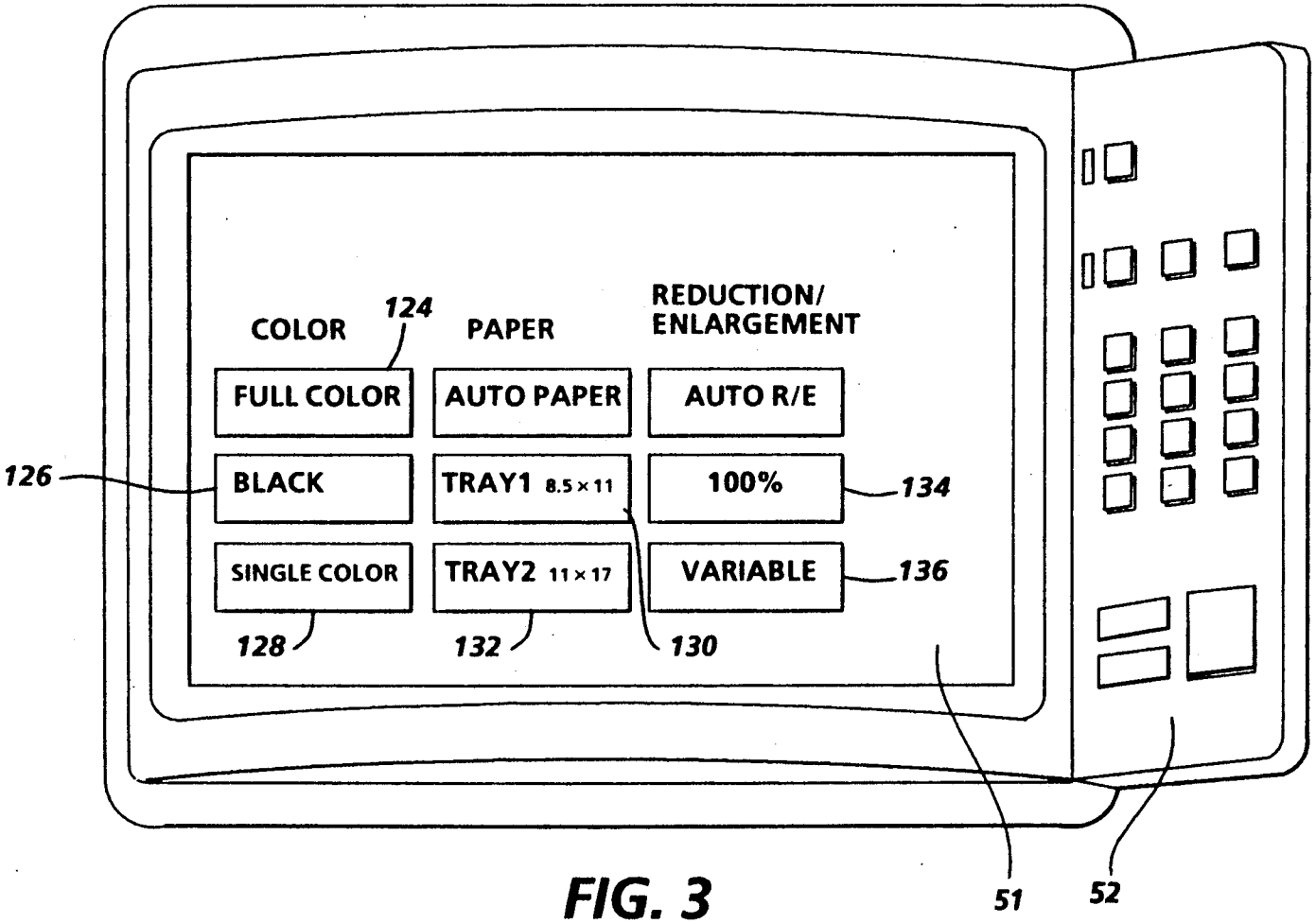
FIG. 3 is an exploded view of the touch monitor screen depicted in FIG. 2.

For purposes of understanding the present invention, it is only necessary to know that the base machine 30 has control software resident on several printed circuit boards that communicate with each other using a common network that the base machine 30 has a user interface 36 that is controlled by software that is also part of the common network, illustrated by printed circuit board 108 and that a modem 120 is provided for remote communication. FIG. 3 is merely a simplified version of the color display unit 51, and hardware control panel 52 of the user interface 36 illustrating various soft control buttons such as full color 124, block 126, single color 128, tray 1 (130), tray 2 (132), and auto reduction/enlargement including 100% (134) and variable 136.

The printed circuit board 108 controlling the user interface 36 is able to monitor all communications on the network 98 and display the communications on the screen 51. Each of the memories 112, 114, 116, and 118 suitably store key status, event, and fault data related to the machine for access by a service representative, and display on screen 51, or for remote transmission via modem 120. In the event of a machine malfunction, the service representative enters a hard key sequence that is recognized by the printed circuit board 108. This recognition of the key sequence by the printed circuit board 108 enables the control 108 to monitor the communications network 98 and display the communications appearing on the screen 51.

The machine operator is able to set up or program the next job or a future machine job as illustrated by the touch screen 51 in FIG. 3. That is, by suitable selection of displayed features, a job can be programmed such as full color, black, or single color, or a particular size paper such as tray 1 containing 8.5×11" copy sheets or tray 2 containing 11"×17" copy sheets, or select a particular reduction/enlargement mode for example, 1009 or variable.

It should be understood that the screen 51 of FIG. 3 is exemplary and that additional soft buttons can be displayed in the same frame or subsequent frames and can be selectively engaged by the operator. Also there can be a selection of suitable hard buttons shown on the panel 52 in accordance well known preprogramming techniques. For example, either hard or soft buttons can be used to select full size copies, 94% size copies, 77% size copies or any variable size copy as well as buttons to engage a recirculating document feeder to operate in a collate mode or non-collate mode. In addition, suitable buttons can enable the operator to select, in a given machine environment, finisher operations such as stapled, non-stapled, non-collated, and such features as duplex copying and offset stacking.

Figure 4:
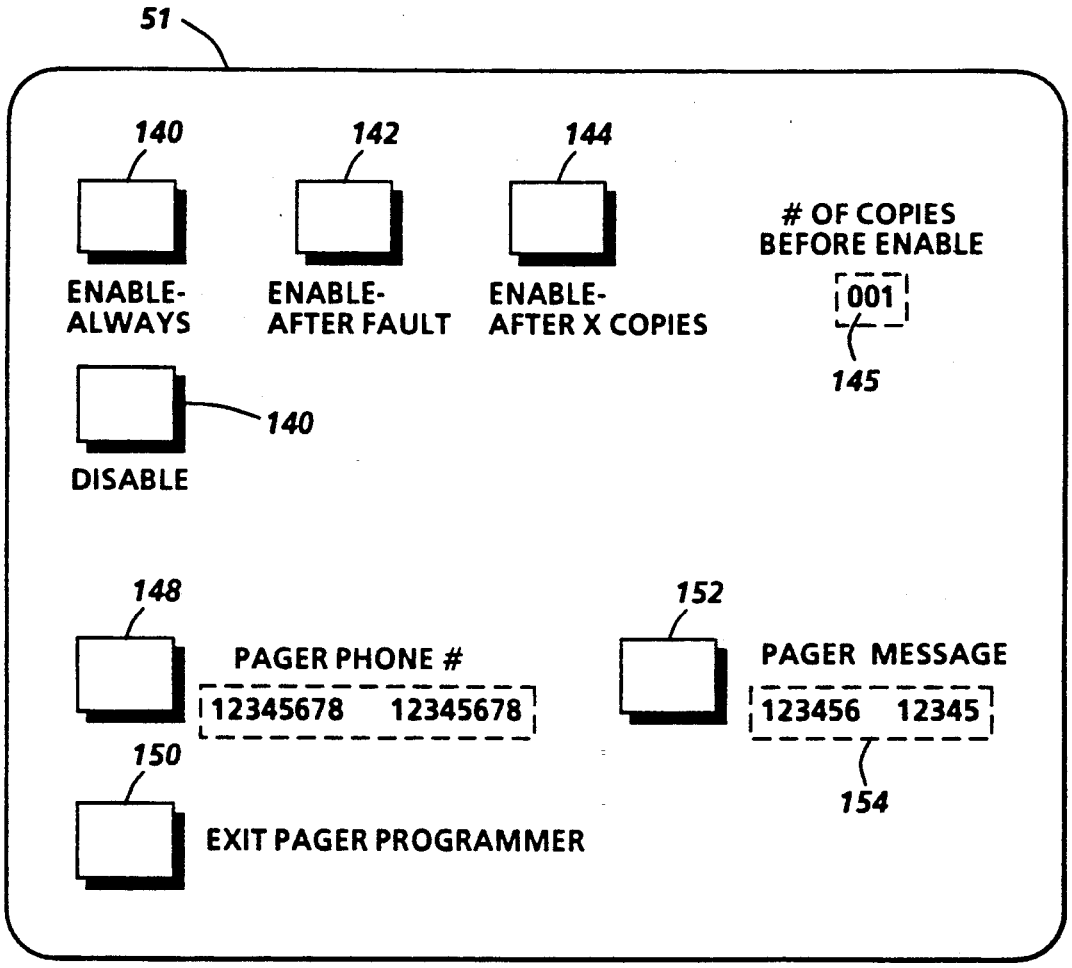
FIG. 4 is an exploded view of the touch monitor screen depicted in FIG. 2 illustrating operator selection of automatic call conditions in accordance with the present invention.

In accordance with the present invention, with reference to FIG. 4, there is shown a typical screen display for programming or presetting a machine for remote communication or notification. The communications can be through modem 120 to a remote location via suitable telephone lines or via a wireless communication system, for example, to a digital pager such as Mobil Comm R pager. Preferably, any suitable network would be desirable in order to provide an operator or machine monitor with suitable notification about a specific machine when present at one of several remote locations attending to other machines.

As shown in FIG. 4, several features are available to preset the conditions for the notification to the remote location. For example, soft button 140 on screen 51 illustrates "enable always" that is, remote communication or notification will be generated at anytime upon the occurrence of pre-selected events. On the other hand, button 142 enables the system to initiate remote communication only after a given fault, and button 144 enables the system to initiate a remote call only if a particular job is programmed for "x" or greater number of copies. Window 145 illustrates a button to enable the operator to preset "x" for a given number. It should be noted that buttons 140, 142, and 144 are merely examples of various options that could be made available to an operator or available at a specific user interface for a specific machine. Other buttons for presetting features are contemplated such as specifically identifying only certain faults that would trigger the remote call. These faults could be an out of copysheet condition in general, an out of copysheet condition at a specific copysheet tray, or a low toner condition. Other conditions could be preset such as making the remote call after a given job has been completed or after a predetermined period of time after a job has been completed. The disable button 146 provides the option to deactivate or disengage the remote call system at the preference of the machine monitor or key operator as conditions might dictate.

Button 148 provides the means to identify the particular remote station. The number could be the number of a machine at a remote location interconnected over telephone lines or preferably the number of a portable pager in the possession of a key operator or machine monitor. Button 152 provides the means to code various messages as illustrated in window 154. These coded messages can be displayed on any suitable pager such as the Mobile Comm R digital pager. Button 150 on screen 51 merely enables the machine operator to exit the pager programming frame to other frames for display at the user interface.

Figure 5:
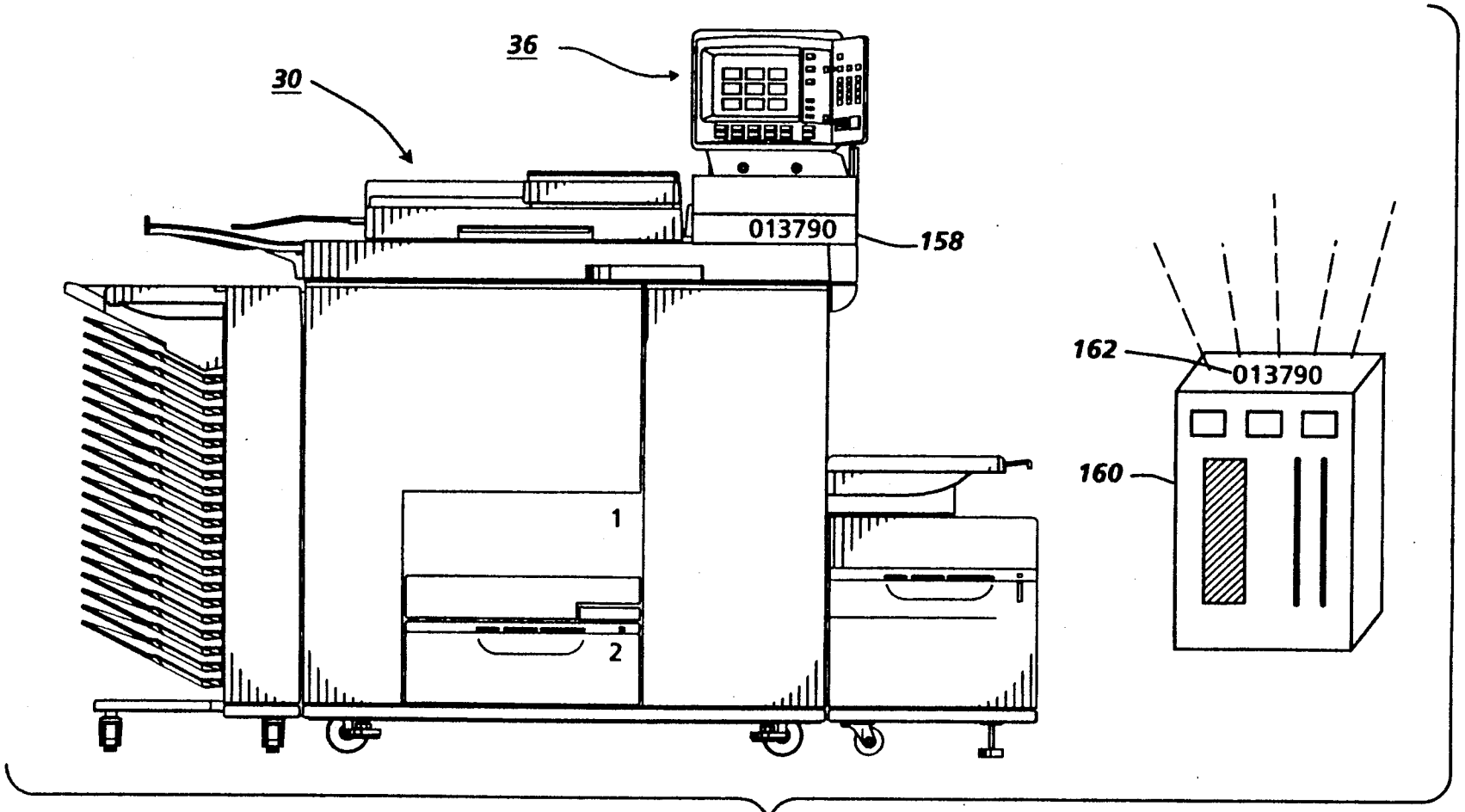
FIG. 5 illustrates one method of machine/remote station in accordance with the present invention.

With reference to FIG. 5, there is illustrated machine to pager communication. The machine 30 with user interface 36 has a machine identification number 01379 illustrated at 158. In accordance with the present invention, pager 160 is illustrated at a location remote from machine 30. Upon detection of any given condition such as an out of paper condition, a predetermined fault condition, or an end of job, machine 30 automatically initiates a call to pager 160 via modem 120 shown in FIG. 2. It should be understood that any of the various conditions to initiate the automatic call have been suitably sensed within machine 30 and an indication or data pertaining thereto has been suitably stored in memory 112, 114, 116, or 118 or any other suitable temporary or random access memory. Upon sensing the condition, the control initiates the external call via modem 120 by any suitable means such as well known in the art. The pager 160 receives the call and provides an audio or other signal to manifest that a call is also being received as is also well known in the art. At a suitable window 162 of pager 160, the transmitted message or code from machine 30 is displayed, for example, the identification number 013790 for the machine 30 to identify the calling source. In addition to the identification 013790, other suitable coded messages can be transmitted and displayed in window 160. For example, the displayed codes would represent the predetermined conditions set into the machine 30 by the operator with the pager programming frame as illustrated in FIG. 4. These coded message would then be observed by an operator or machine monitor in possession of the pager 160 to identify a particular machine having a particular condition.

Figure 6:
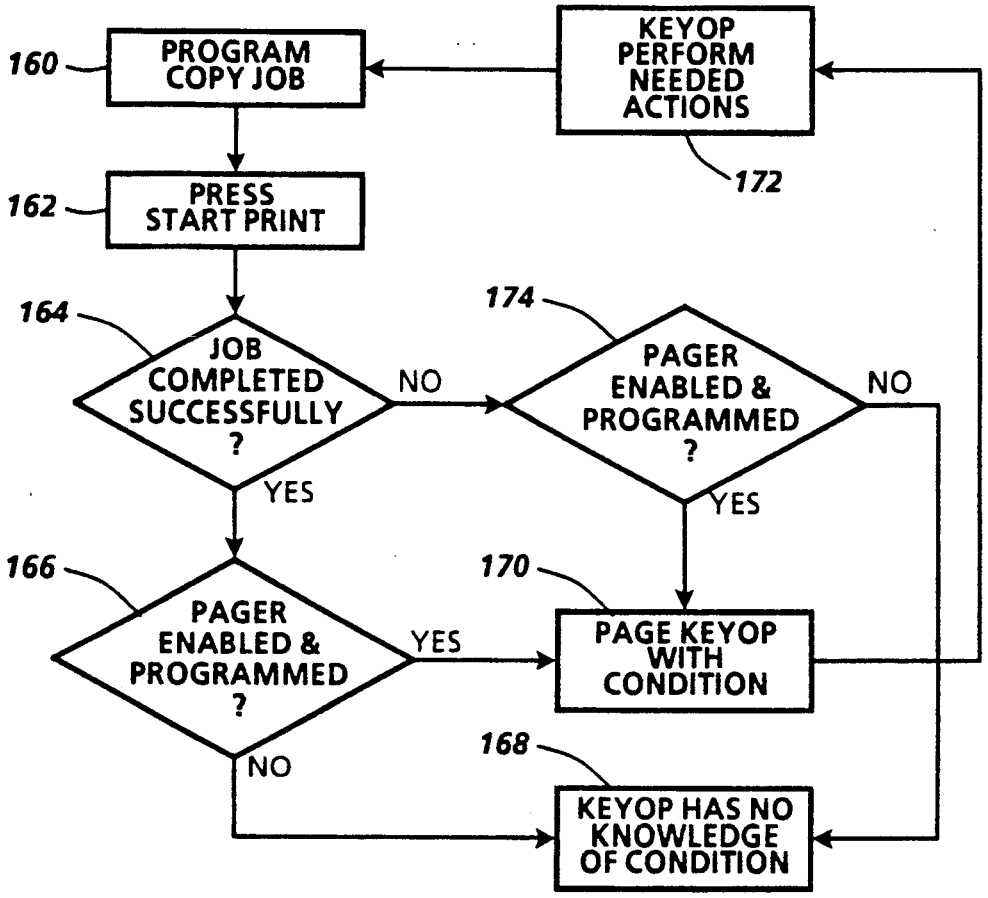
FIG. 6 is a flow chart illustrating automatic remote notification in accordance with the present invention.

FIG. 6, illustrates a typical remote notification scenario in accordance with the present invention. A job is set up and initiated at blocks 160 and 162. At block 164 there is a decision as to whether or not the job has been completed. Job completion could have been one of the conditions preset into the control. If the job has been successfully completed, there is a decision as to whether or not the remote pager has been enabled and programmed for this particular condition as illustrated at block 166. If the pager has not been enabled and programmed for remote call initiation, as illustrated at block 168, there will be no notification to the remote pager. The machine monitor or key operator will therefore have no knowledge of the particular condition and the machine will remain idle unless pre-programmed for multiple jobs.

If in fact the machine has been pre-programmed to initiate a remote call after the successful completion of a job, then the key operator will be paged upon completion of the job illustrated at block 170. Block 172 merely illustrates the key operator responding in some manner to the remote communication, presumably to return to the machine to initiate another job or perform any other maintenance routines. If the job has not been successfully completed then at block 174 a determination is made as to whether or not the remote call has been programmed and enabled. If not, no message will be communicated remotely as illustrated at block 168 and the machine will presumably remain idle. On the other hand, if the machine has been preset for a remote communication upon the particular event preventing completion of the job then, at block 170 a remote communication will be made to the pager with a code identifying the machine and the specific condition generating the call.

Figure 7:
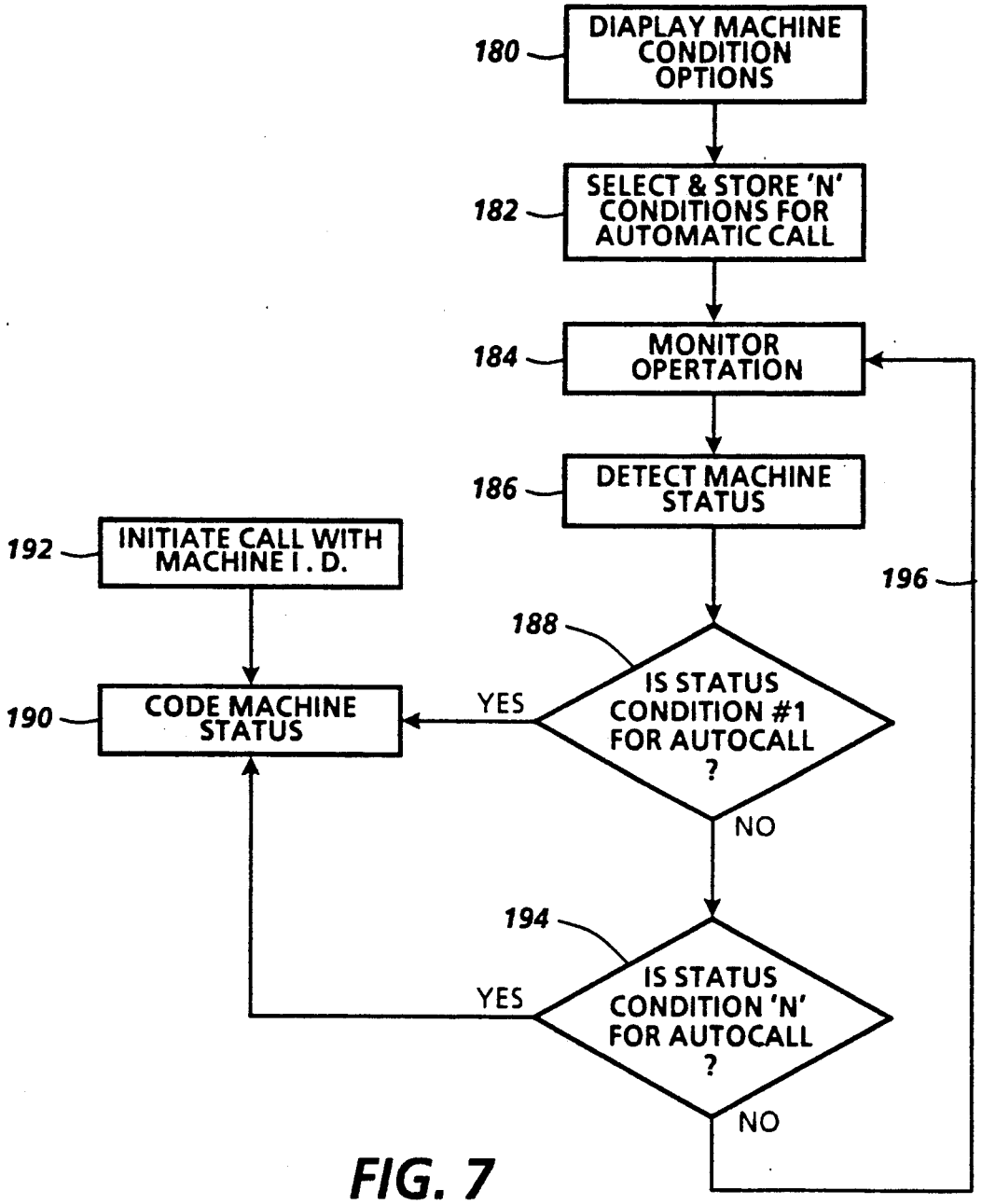
FIG. 7 is a flow chart illustrating machine status determination for remote notification in accordance with the present invention.

With reference to FIG. 7, there is another scenario of automatic call. At block 180 there is a display of machine condition options to be preset for automatic call, at block 182 the key operator selects "N" conditions for automatic call. It should be understood that the necessary codes to identify the conditions for call are already assumed to predetermined. At block 184, the machine operation has been initiated and the machine is in a monitoring operation. At block 186 there is a detection of a machine status or condition. This could be any fault, condition, or event of the machine. Most of these detected events or conditions, however, will not initiate an automatic call to the pager. At block 188, the decision is made as to whether or not a detected machine status is status condition #1 of the stored "N" conditions for automatic call. If yes, the machine status is converted into a code at block 190 for remote communications, and at block 192, a call is initiated to the remote station or pager with the appropriate machine identification. If the detected machine status on the other hand, is not condition 1 of the stored "N" conditions a decision is made as to whether or not the detected machine status is condition #2 of the stored "N" condition. If yes, a remote communication call is initiated identifying condition #2. If not, the detected machine status is compared to stored condition 3. This sequence continues until, if the detected machine status is not any of the 1 through "N" minus one of the stored "N" conditions for automatic call, the decision is made as to whether the detected machine status is condition "N" for automatic call as illustrated at decision block 194. If yes, the machine status is coded at 190 and the call is initiated to the remote station with the machine identification as illustrated at block 192. If the detected machine status is not conditioned "N" of the stored "N" conditions for automatic call, then no automatic call is required and the machine continues operation and monitoring as illustrated by the loop 196 to block 184.

It should also be understood that the scope of the present invention is intended to cover not only setting the machine or configuring the machine for a next subsequent job to be initiated immediately after the completion of the copy quality adjustment, but also to cover the preprogramming of the machine to initiate a complete job run after the completion of a job run in process that has been interrupted by the copy quality adjust sequence.

While the invention has been described with reference to the structure disclosed, it is not confined to the details set forth, but it is intended to cover such modifications or changes as may come within the scope of the following claims.

We claim:

1. In an image processing apparatus having image processing components for forming images on a medium, a controller for directing the operation of the image processing components including a machine monitoring element to sense predetermined machine conditions and an operator interface connected to the controller, the operator interface including a display, the method of automatic notification to a selected remote station in response to the machine conditions detected by the machine monitoring element comprising the steps of:

displaying machine condition options for operator selection of predetermined machine conditions for automatic notification to a remote station, selectively programming the predetermined machine conditions for notification to the remote location, monitoring the operation of the image processing apparatus relative to forming images on the medium, detecting a machine condition, determining the machine condition to be a condition to require a notification to the remote location, and automatically initiating a notification to the remote location, the notification including a designation of the image processing apparatus and the type of machine condition.

2. The method of claim 1 wherein the step of selectively programming the conditions for notification to the remote location includes the step of programming an out of paper condition for notification to the remote location.

3. The method of claim 1 wherein the step of selectively programming the conditions for notification to the remote location includes the step of programming a job interrupt condition for notification to the remote location.

4. In an image processing apparatus having image processing components for forming images on a medium, a controller for directing the operation of the image processing components including a machine monitoring element to sense predetermined machine conditions and an operator interface connected to the controller, the method of automatic notification to a selected remote station in response to the machine conditions detected by the machine monitoring element comprising the steps of:

selectively programming the image processing apparatus for notification to the selected remote station, monitoring the operation of the image processing apparatus relative to forming images on the medium, detecting a machine condition, determining the machine condition to be a condition to require a notification to the remote location, and automatically initiating a notification to the remote location, the notification including a designation of the image processing apparatus and the type of machine condition.

5. The method of claim 4 including the step of selectively programming the conditions for notification to the remote location.

6. The method of claim 5 wherein the step of selectively programming the conditions for notification to the remote location includes the step of programming an out of paper condition for notification to the remote location.

7. The method of claim 5 wherein the step of selectively programming the conditions for notification to the remote location includes the step of programming a job interrupt condition for notification to the remote location.

8. The method of claim 5 wherein the step of selectively programming the conditions for notification to the remote location includes the step of programming a low toner condition for notification to the remote location.

9. The method of claim 5 wherein the step of selectively programming the conditions for notification to the remote location includes the step of programming an end of job condition for notification to the remote location.

10. The method of claim 5 wherein the operator interface includes a display and the step of selectively programming the conditions for notification to the remote location includes the step of displaying program options for operator selection.

11. An image processing apparatus having image processing components for forming images on a medium comprising:

a controller for directing the operation of the image processing components, a machine monitoring element connected to the controller to sense predetermined machine conditions, means for determining a predetermined machine condition requires notification to a remote location, means for selectively setting the image processing apparatus for notification to the remote location, and means for automatic notification to the remote station in response to the machine conditions detected by the machine monitoring element, the means for automatic notification including means to designate the image processing apparatus and the type of machine condition.

* * * * *